US005979514A

United States Patent [19]

Andersson et al.

[11] Patent Number: 5,979,514

[45] Date of Patent: Nov. 9, 1999

[54] HYGIENIC FILL SYSTEM FOR A PACKAGING MACHINE

[75] Inventors: Bengt Andersson, Palatine; Yutaka Kaneko, Wheeling, both of Ill.

[73] Assignee: Tetra Laval Holdings & Finance, SA, Pully, Switzerland

[21] Appl. No.: 09/014,753

[22] Filed: Jan. 28, 1998

[51] Int. Cl.[6] ..... B65B 1/04

[52] U.S. Cl. ..... 141/91; 141/93; 141/237

[58] Field of Search ..... 141/85, 89, 90, 141/91, 92, 93, 236, 237

[56] References Cited

U.S. PATENT DOCUMENTS

| | | | |
|---|---|---|---|
| 4,832,096 | 5/1989 | Kohlbach . | |
| 4,842,026 | 6/1989 | Nordmeyer et al. . | |
| 4,893,659 | 1/1990 | Löliger . | |
| 4,964,444 | 10/1990 | Hanérus et al. . | |
| 4,989,392 | 2/1991 | Lindgren et al. . | |
| 4,989,649 | 2/1991 | Weiler et al. . | |
| 4,991,633 | 2/1991 | Wong . | |
| 4,993,598 | 2/1991 | Groninger . | |
| 5,099,895 | 3/1992 | Loeliger . | |
| 5,223,217 | 6/1993 | Frizziero . | |
| 5,313,990 | 5/1994 | Clüsserath . | |
| 5,348,058 | 9/1994 | Ruhl | 141/90 |
| 5,431,198 | 7/1995 | Turtchan . | |
| 5,533,550 | 7/1996 | Franke et al. . | |
| 5,687,779 | 11/1997 | Andersson et al. | 141/90 |
| 5,782,274 | 7/1998 | Kaneko et al. | 141/90 |
| 5,810,059 | 9/1998 | Rutter et al. | 141/90 |

*Primary Examiner*—Steven O. Douglas

[57] ABSTRACT

The fill system provides sterile air to the product tank and the cleaning box which creates a more hygienic environment for the forming, filling and sealing of cartons on a packaging machine. The fill system has a pair of offset reducers for facilitated positioning of the fill pipes in relation to each other. The fill system also has a tank atmospheric valve for maintaining the proper pressure in the product tank. The fill system also has a level probe for measuring the level of product in the product tank during a production cycle, and to measure the level of cleaning solution in the product tank during a cleaning cycle.

12 Claims, 8 Drawing Sheets

HYGIENIC FILL SYSTEM FOR A PACKAGING MACHINE

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a fill system for a packaging machine. Specifically, the present invention relates to a hygienic fill system for a linear form, fill and seal packaging machine.

2. Description of the Related Art

Packaging machines are known that integrate into a single unit the various components necessary to form a container, fill the container with a liquid product, and seal the container. Such packaging machines typically feed carton blanks into the machine, seal the bottoms of the cartons, fill the cartons with a product dispensed from a product storage tank, seal the tops of the cartons, and off-load the filled cartons for shipping.

A popular type of carton is an Extended Shelf Life ("ESL") carton due to the added value such a carton presents to a retailer. For example, pasteurized milk processed and packaged under typical conditions has a shelf life at four degrees Celsius of seven to fourteen days while the same milk processed and packaged under ESL conditions has a shelf life of fourteen to thirty days. Under ESL conditions, juice may have a shelf life of forty to one-hundred twenty days, liquid eggs sixty to ninety days, and egg nog forty-five to sixty days. Thus, ESL packaging greatly enhances a product since it extends the time period that the particular product may be offered for sale to the consuming public. An ESL carton is the final component of an ESL system which entails ESL processing and ESL filling. In order to have ESL filling, the filling system should be kept sterile in order to prevent contamination of the product or carton during filling on a form, fill and seal package machine.

As the product is dispensed from the product tank during the packaging process, compensation must be made for the displacement of the product in the product tank. Thus, it is desirable to vent the product tank in order to compensate for the displacement of the product. Where the product is a liquid foodstuff, it may be necessary to maintain a sterile environment in the tank. Therefore, the tank cannot be vented to the open atmosphere.

One solution to the problem of venting the product tank while maintaining a sterile environment in the product tank is set forth in U.S. Pat. No. 5,009,339 to Hanerus et al. The '339 patent illustrates an apparatus for venting a plant for filing containers. The apparatus includes two control valves disposed at an outlet from the product tank and a vacuum pipe and pump assembly provided along an upper edge of the product tank.

Although a product tank can be vented in this manner at conventional operating speeds, new problems are presented as packaging machines are designed for ever-increasing through put capacities. Specifically, cartons are typically lifted into a sterile filling environment. At high operating speeds, sterile air that is displaced by lifting the cartons to be filled into the filling environment presents a problem that is not dealt with in the prior art, namely the problem of venting both the filling environment and the product tank. Additionally, vents disposed exterior to the tank present problems with clean in place (CIP) systems since the vent must necessarily be cleaned in a separate, manual cleaning step.

As a result, Franke et al. disclose in U.S. Pat. No. 5,533,550 an apparatus for internally venting a product tank in a packaging machine which solves the problems of the '339 patent. The Franke et al. patent is owned by the assignee of the present application.

In addition, a filtered clean air supply is necessary for the product tank. Such a filtered clean air supply is used to supply clean air for breathing in the tank and cleaning the box during production and also to keep the level low in the product tank during cleaning. A need exists for such a filtered clean air supply at the top of the product tank.

BRIEF SUMMARY OF THE INVENTION

The present invention resolves the problems of the prior art by providing a fill system with a source of sterile air in flow communication with the product tank and the cleaning box. The present invention also has a means for measuring the level of the cleaning solution in the product tank. Further, the present invention has a tank atmospheric valve for maintaining the proper pressure in the product tank of the fill system.

It is a primary object of the present invention to provide a filtered clean air system for a packaging machine.

It is an additional object of the present invention to provide an adjustable fill system for adjusting the filling position.

It is an additional object of the present invention to provide a fill system having conical reducers for adjusting the fill system.

It is an additional object of the present invention to provide a sterile air system for drying out the fill system.

It is an additional object of the present invention to provide a sterile air system for cooling the fill system subsequent to steam sterilization.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

Several features of the present invention are further described in connection with the accompanying drawings in which:

There is illustrated in FIG. 1 a perspective view of an embodiment of a fill system for a packaging machine of the present invention;

Figure 2:
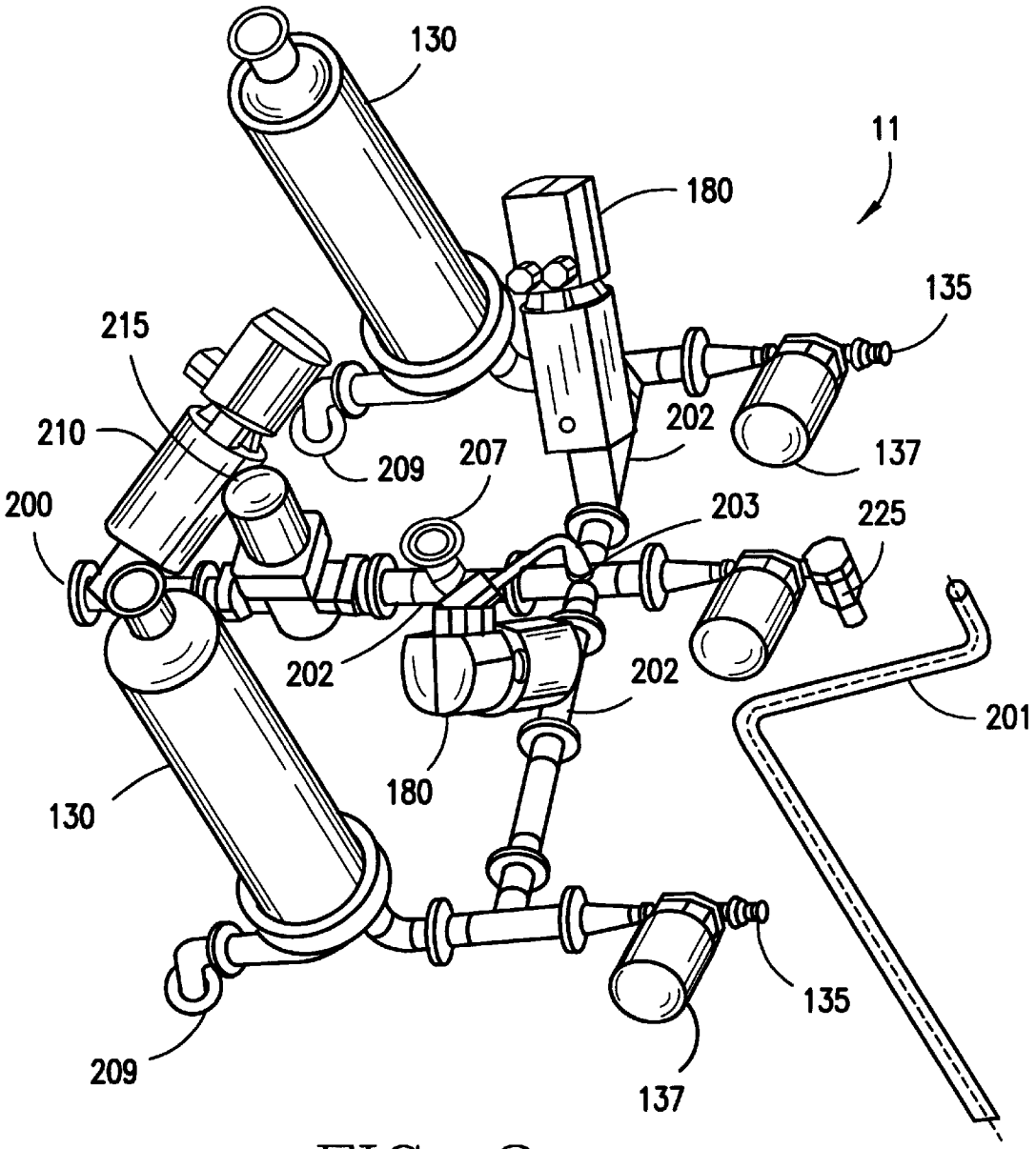
Figure 3:
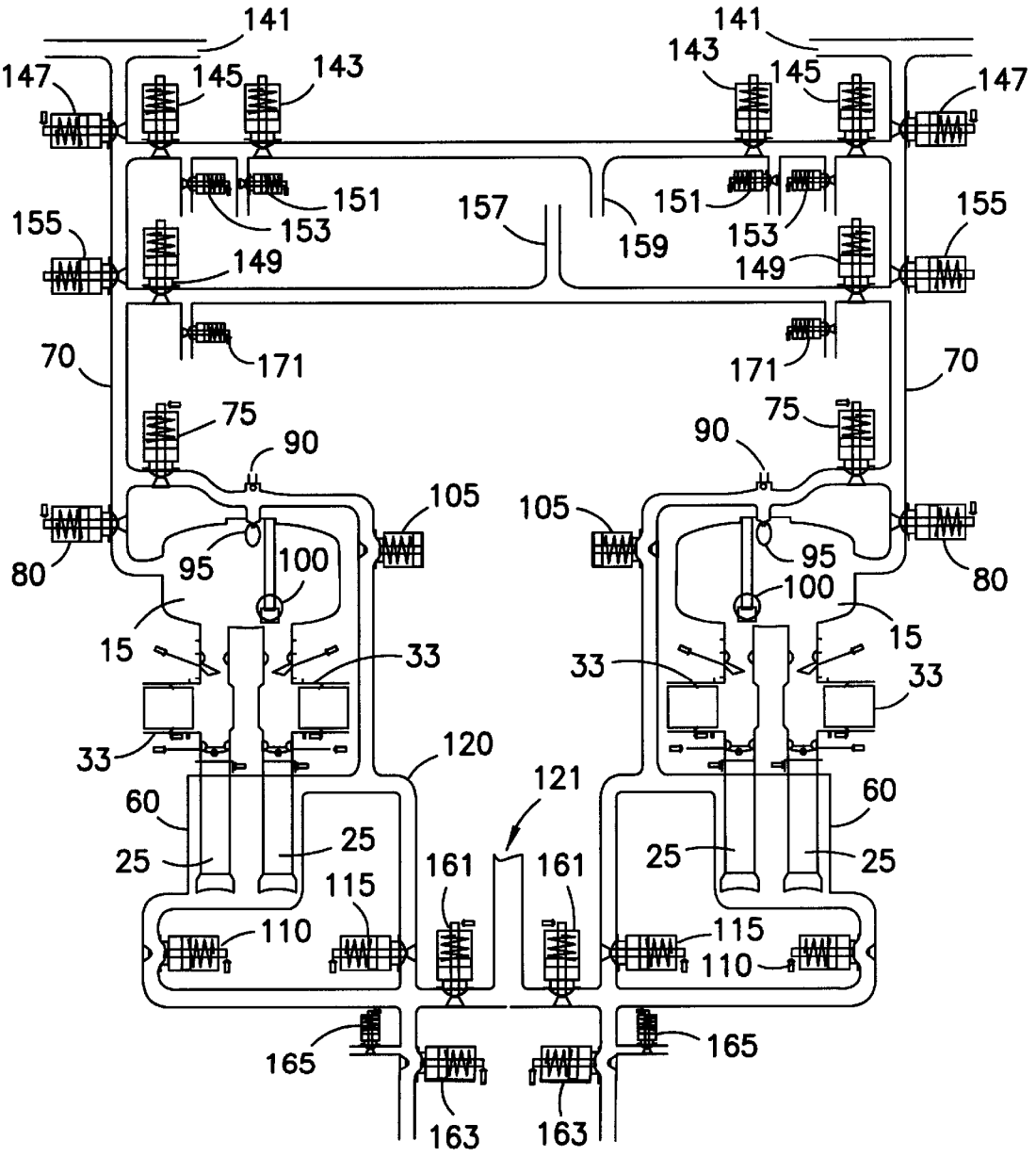
Figure 4:
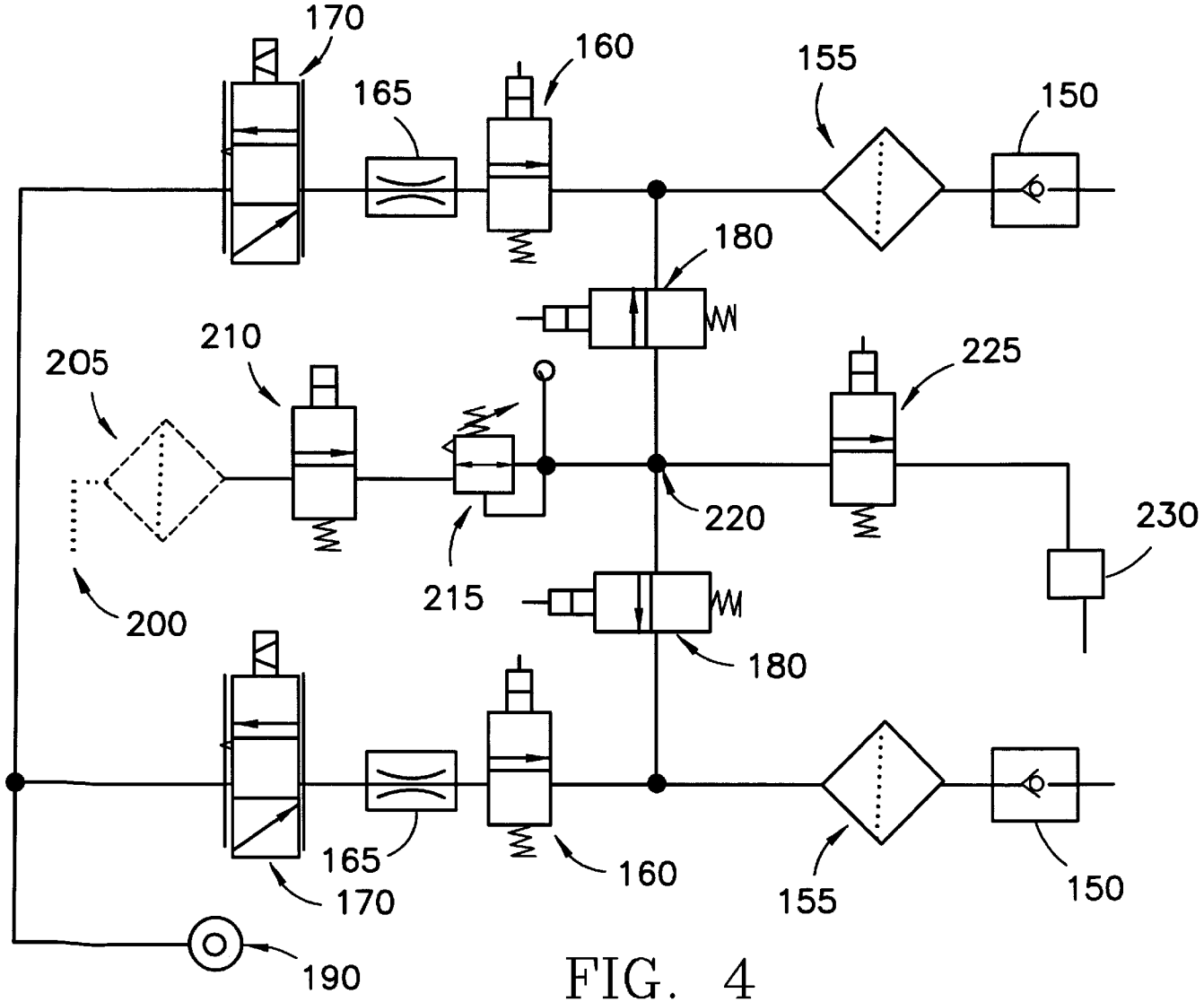
Figure 5:
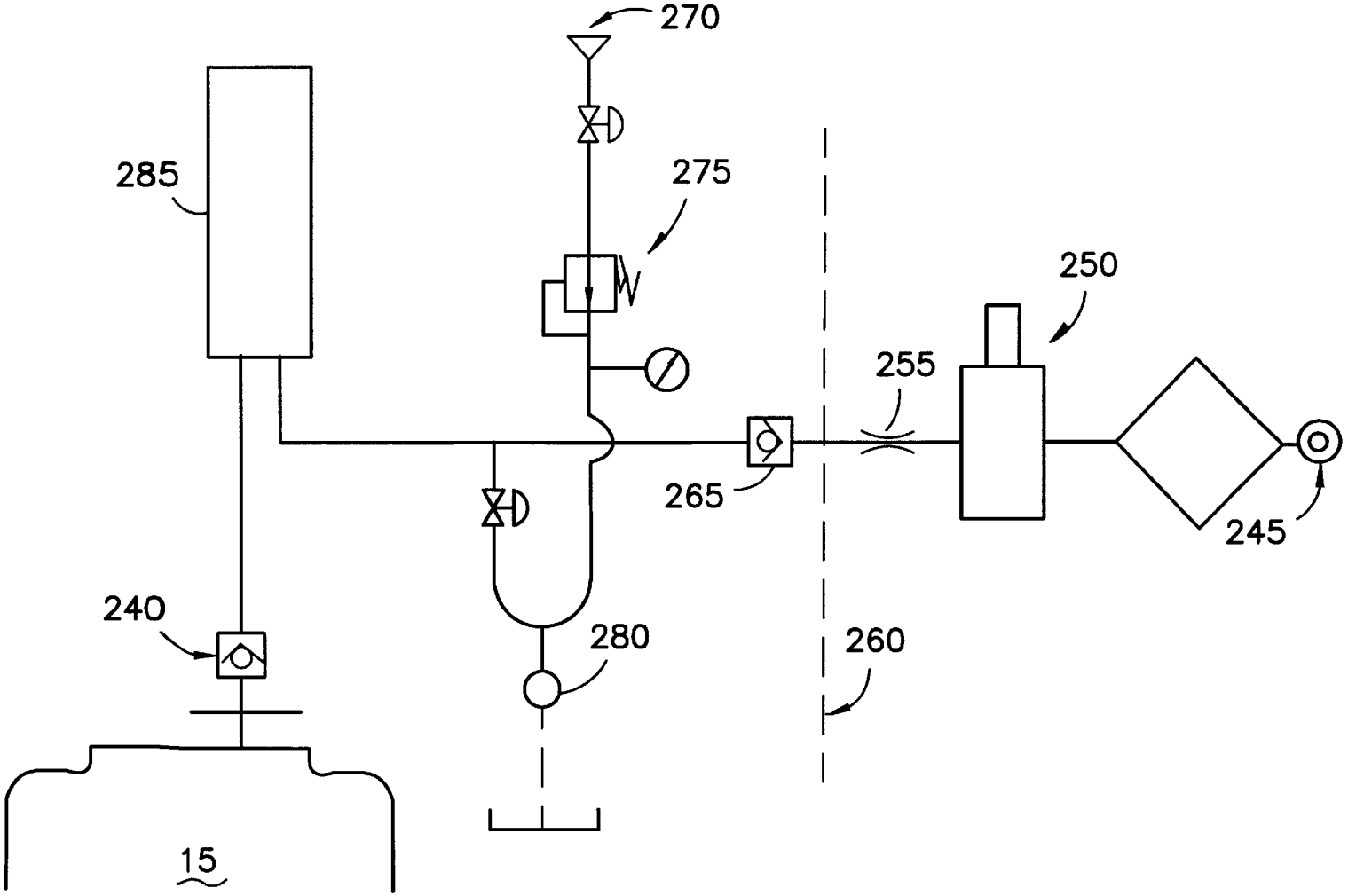
Figure 6:
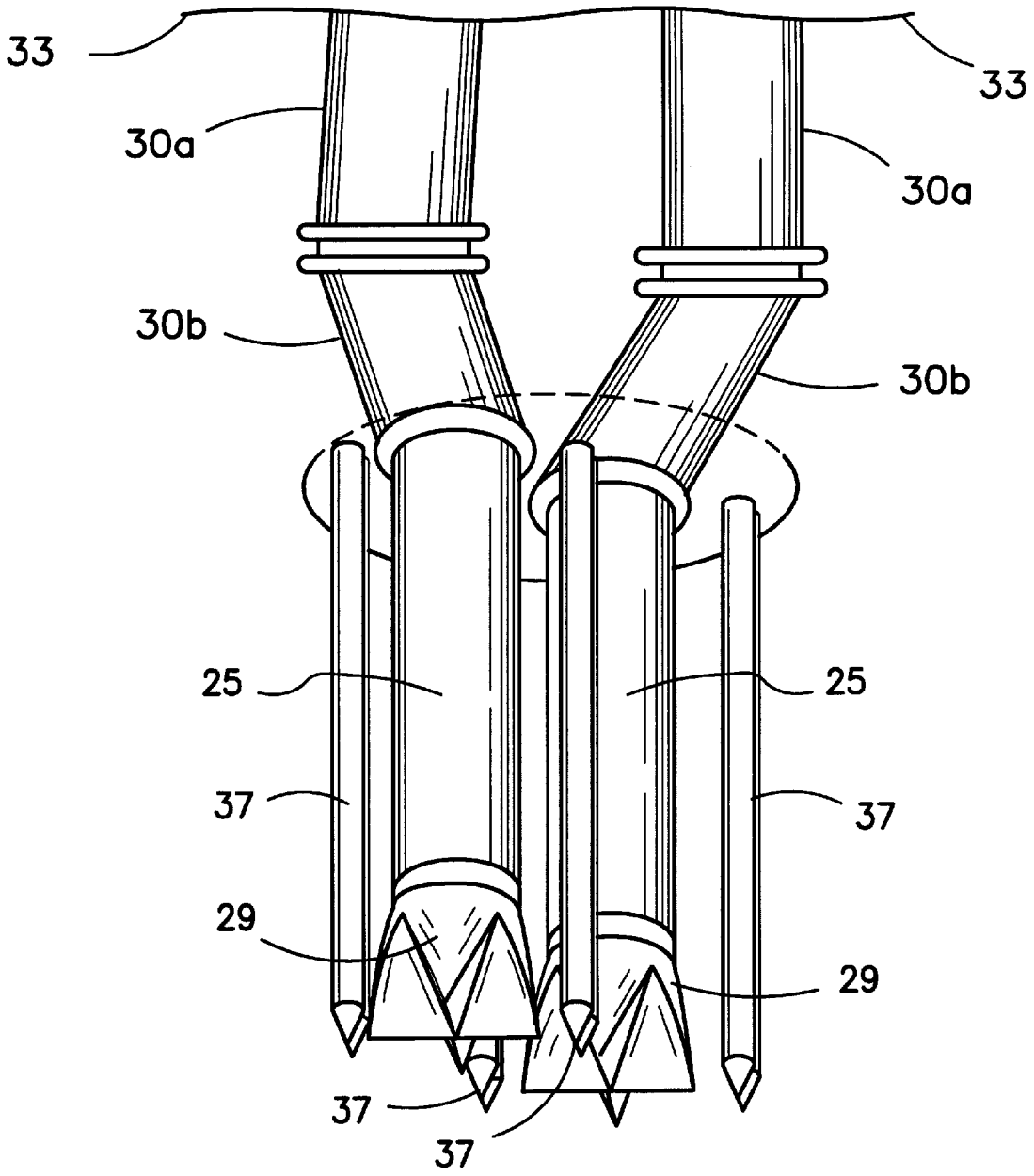
Figure 7:
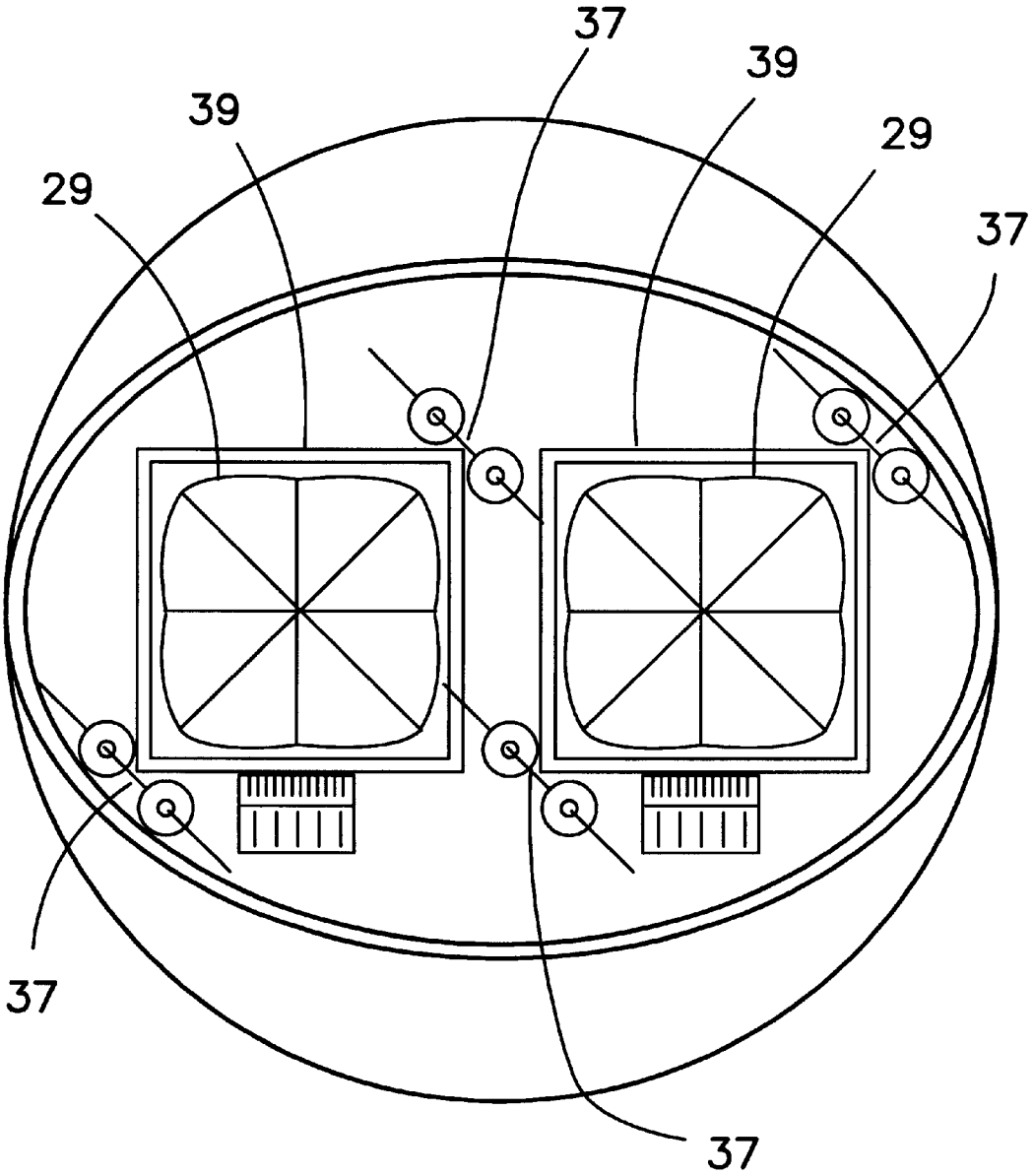
Figures 8A, 8B:
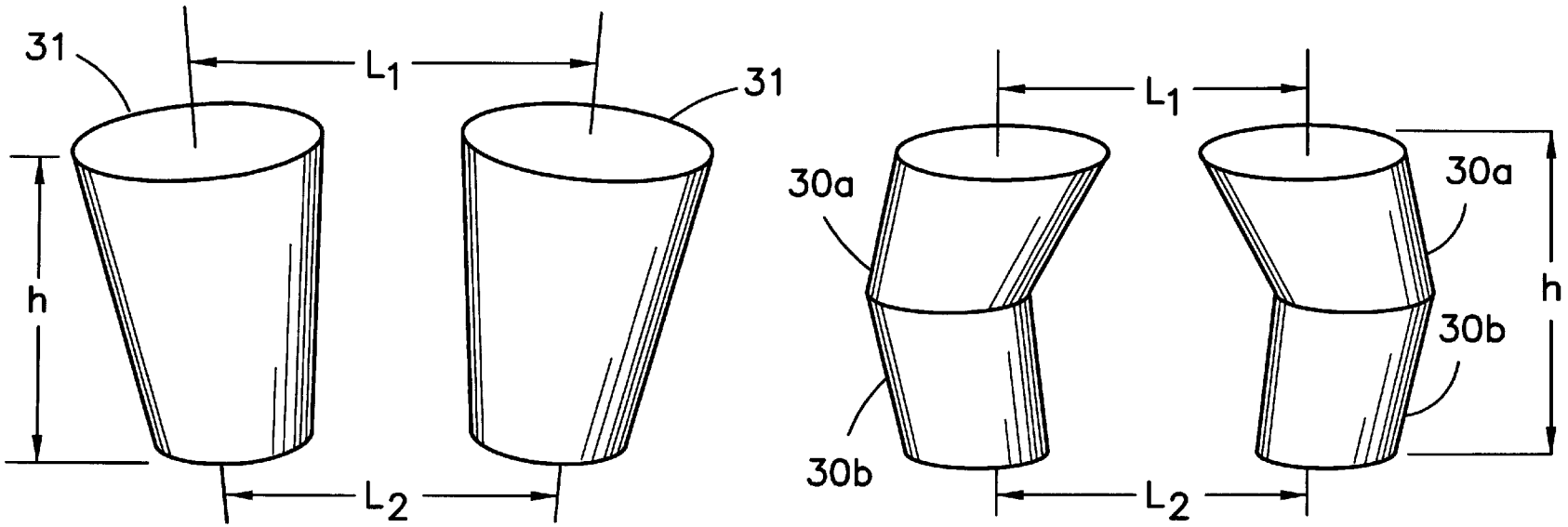
FIG. 8A (PRIOR ART)

There is illustrated in FIG. 2 a perspective view of a steam and sterile air system for a fill system of the present invention;

There is illustrated in FIG. 3 a schematic diagram of an embodiment of a fill system for a dual line packaging machine of the present invention;

There is illustrated in FIG. 4 a schematic diagram illustrating an embodiment of the valving and flow patterns of the present invention;

There is illustrated in FIG. 5 a schematic diagram illustrating an embodiment of the valving and flow patterns of the present invention;

There is illustrated in FIG. 6 a perspective view of reducers, fill pipes and nozzles of the fill system of the present invention;

There is illustrated in FIG. 7 a cross-section view of FIG. 6 with a pair of cartons about to undergo filling to demonstrate the closeness of cartons used on the fill system of the present invention;

There is illustrated in FIG. 8A prior art reducers;

There is illustrated in FIG. 8B reducers of the present invention;

DETAILED DESCRIPTION OF THE INVENTION

The present invention is directed in particular to a linear form, fill and seal packaging machine for gable-top cartons such as a TETRA REX® machine available from Tetra Pak, Incorporated of Chicago, Ill. The present invention greatly enhances the hygienic nature of such machines and allows for spaces savings due to the positioning of the fill pipes. However, those skilled in the pertinent art will recognize that the scope and spirit of the present invention may be applied to other packaging machines in necessity of increased hygienic standards.

Figure 1:
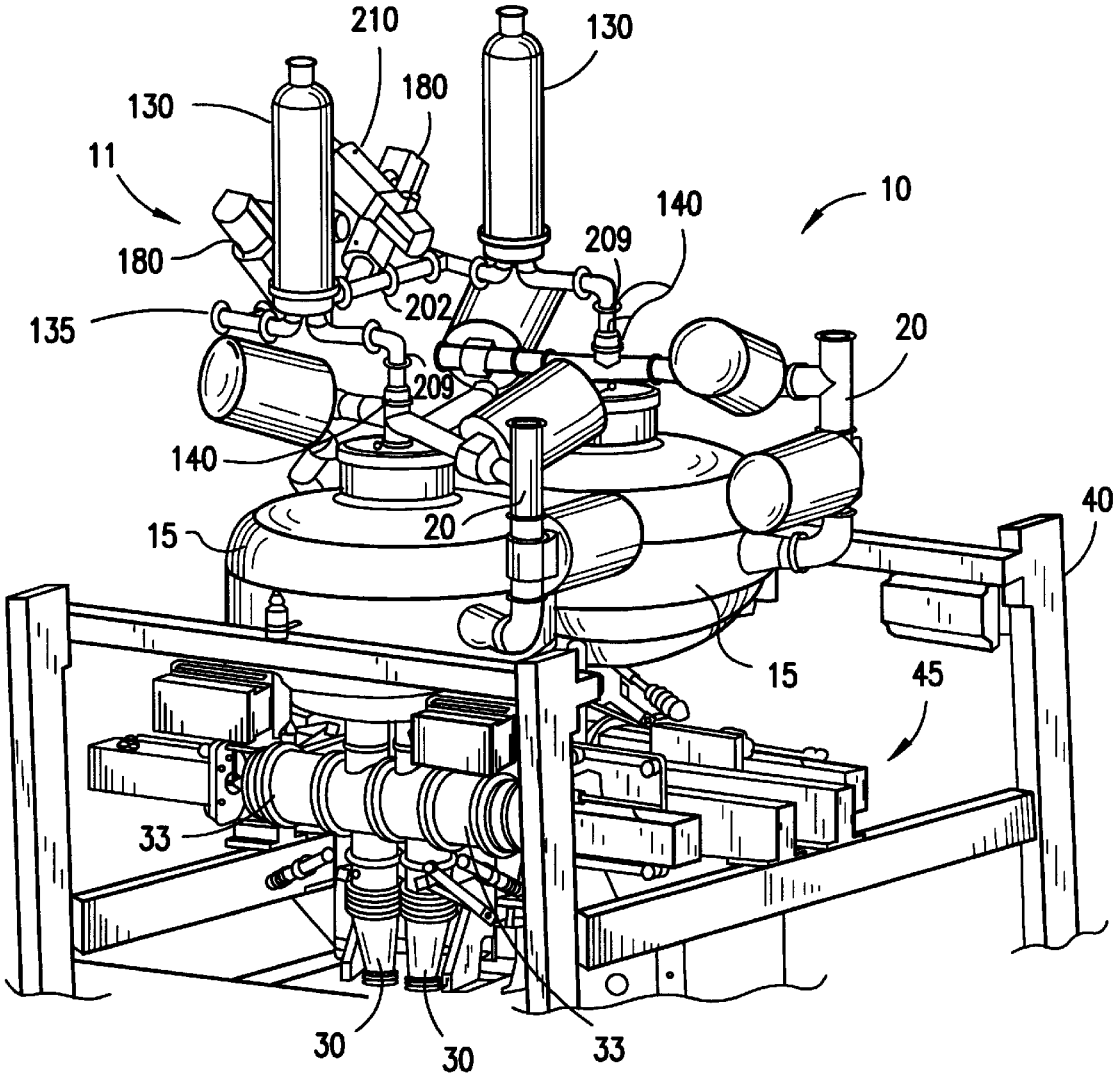

There is illustrated in FIG. 1 a perspective view of an embodiment of a hygienic fill system for a packaging machine of the present invention. More particularly, FIG. 1 illustrates a fill system indicated generally at 10. The fill system 10 is illustrated as a dual line fill system. For example, two sets of identical components are provided for filling two lines of containers. In particular, each line of the fill system 10 includes a product tank 15 in flow communication with a product supply (not shown) via appropriate piping 20. Each product tank 15 is flow communication with pair of fill pipes 25, not shown, via fill pumps 33 and reducers 30, further described below. A framework 40 supports the product tanks 15 via transverse frame members 45 which allow adjustments of the fill system relative to the product filling line.

Disposed above each of the product tanks 15 is a steam and sterile air supply system 11 which is shown detached in from the packaging machine in FIG. 2. This system 11 will be described in reference to FIGS. 1 and 2. The steam and sterile air system 11 has many functions within the packaging machine, however, there are four predominant functions performed by the system 11. During a production run, that is when cartons are being filled and processed on the packaging machine, the system flows sterile air to a cleaning box 60, shown in FIG. 3. During cleaning of the fill system, after a production run, sterile air is used to maintain the cleaning detergent level in the product tank 15. After cleaning, the steam is used to sterilizes the fill system 10, then the sterile air is used to lower the temperature of the previously steamed components from 121° C. to approximately 20° C. The fourth predominant function is performed during a production change, where the sterile air is used to dry out the fill system 10.

Air is supplied through air inlets 135 which are in flow communication with an air supply, not shown. The air flowing into the system 11 from air inlets 135 is first filtered through a coalescing filter 137 before flowing to a sterile air filter 130. After the sterile air filter 130, the air is introduced into the rest of the fill system 10 through outlet 209, through tank check valve 140 and to the product tank 15. Steam is supplied to the system 11 through steam inlet 200 which is controlled by a main steam supply valve 210 and regulated by a steam pressure regulator 215. Auxiliary steam supply valves 180 are further downline along steam piping 202 which directs the flow of steam through the system 11. A thermocouple 203 is provided at a junction of the steam piping 202. In flow communication with the junction is a steam trip valve 225 in flow communication with a steam drain 201. There is also disposed within the steam flow an outlet to a pressure gauge 207.

FIG. 3 illustrates an embodiment of the fill system 10 of FIG. 1 schematically wherein like numerals represent like parts. As shown, a dual line fill system is provided wherein both lines are connected to one source of product 141 and one source of cleaning supply 157. In this particular embodiment, the lines are adjacent each other on a single linear form, fill and seal packaging machine. However, each line receives product supply and cleaning supply from the same sources. For example, the product supply might be two percent milk maintained in a vat somewhere on the premises of a dairy. The vat is connected to the packaging machine fill system 10 through product supply line 141. Also, for cleaning of the packaging machine fill system 10, a cleaning supply will be maintained somewhere on the premises of the dairy. The cleaning supply will be connected to the packaging machine fill system 10 through cleaning supply line 157. A series of valves allows for the specific control of the product supply and the cleaning supply. A similar valving arrangement is placed on both lines therefore reference to one line will suffice for the other line.

A product supply valve 147 is the first control of the flow of the product from the supply 141 to the tank 15. Further downline is a production cleaning valve 155 which blocks the flow of cleaning fluid to the product supply 141 during a cleaning cycle. A cleaning supply valve 149 controls the flow of cleaning fluid from the cleaning supply 157. A cleaning drain valve 171 is also provided to drain excess cleaning fluid. For steam sterilization control, a steam barrier valve 115 and a steam block valve 143 are provided for controlling the flow of steam and the access of product. Steam condensate valves 151 and 153 are also provided adjacent the steam valves 143 and 145.

A product/cleaning solution intake 70 is arranged near the top of the product tank 15. A spray valve 75 is connected between the product/cleaning solution intake 70 and the top of the product tank 15. Also a product valve 80 is arranged between the product tank 15 and the product/cleaning solution intake 70. A clean filtered air/steam supply 90 is arranged at the top of the product tank 15. Additional components include a cleaning ball 95 for providing clean-in-place (CIP) capability for the product tank 15. Also, a level probe 100 is arranged to determine the level of product in the product tank 15. Additional valves include a tank/atmospheric valve 105 connected in line with the vent pipe 35 between the top of the product tank 15 and the cleaning box 60. A cleaning box valve 110 is located after the cleaning box 60 and a cleaning valve 115 is also arranged in a cleaning pipe 120. A cleaning stop valve 161 is subsequent to the cleaning valve 115. Along a drain, line, a steam condensate valve 165 and a drain valve 163 are arranged thereon. Also shown in flow communication with the product tank 15 are the fill pumps 33 and the fill pipes 25. Thus, each line is capable of dual filling. Encompassing the fill pipes 25, at least during cleaning, is the cleaning, box 60.

FIG. 4 illustrates a steam and sterile air supply (SAS) schematic for the embodiment of this fill system 10 described above. FIG. 4 schematically illustrates the flow patterns of the components illustrated in FIGS. 1 and 2. A tank check valve 150 is connected in line with a sterile air filter 155. The air supply continues on to an air stop valve 160, then passes through a restrictor 165 to an I/P valve 170. A steam supply valve 180 is arranged between the sterile air filter 155 and the air stop valve 160. Identical components are also provided for a second line to of the fill system 10. A sterile air supply 190 from a coalescing filter (not shown) is also provided. In addition, a steam supply illustrated at 200 is connected to a steam filter 205 which feeds a steam supply valve 210. The steam supply valve 210 is further connected to a steam pressure regulator 215. A temperature sensor 220 is arranged in the steam line. Also, a steam trap valve 225 is connected to a steam trap 230 to complete the steam supply. A further schematic diagram of the steam and air supply system (SAS system) is shown in FIG. 5.

FIG. 5 illustrates a product tank 15 having a tank check valve 240 arranged at the top thereof. The tank check valve 240 and air supply 245 is connected to a coalescing filter 250 and passes through a restrictor 255. Dashed line 260 indicates that a part of the system is arranged under a table portion of the frame 40 of the present invention. The components on the right are under the table. A check valve 265 is also illustrated. A steam inlet 270 passes through components illustrated generally at 275 to a steam trap 280. In addition, a filter 285 is connected via the check valve 240 to the product tank 15.

The level and pressure of the product tank have to be controlled very carefully. The level probe 100 keeps track of the tank level in the product tank 15. The pressure sensor, not shown, keeps track of the pressure of the product and the air space which has to be maintained at the same level by means of breathing sterile air through the fill system 10. The pressure transducer, which may be an I/P valve, controls the inflow and pressure of the air. A certain amount of air is bled to the atmosphere by the tank/atmosphere valve 105 shown in FIG. 3. This allows the product tank 15 to breathe the fresh sterile air all the time. This amount of air is to be balanced at all times to provide positive air flow through the orifice although no product is fed to the tank 15 and the level is lowering. To avoid fill in accuracy of product in containers, the pressure as measured by the transducer has to be maintained the same at all times. This is also true at production finish with a low product level.

FIGS. 6 and 7 illustrate another aspect of the present invention, offset reducers 30 which allow for closer positioning of the fill pipes 25 and easier adjustment thereof. The reducers 30 are disposed between the fill pumps 33 and the fill pipes 25. Connected on the other end of each of the fill pipes 25 is a nozzle 29. Positioned about each of the fill pipes 25 are a series of carton guidance rods 37 for proper positioning of the carton 39 when it is lifted for filling thereof with the product. As the carton 39 is filled with product, the carton is lowered to the conveyor mechanism, not shown, for conveyance to a subsequent station, not shown, for sealing. Returning to the offset reducers 30, each offset reducer 30 is composed of a top portion 30*a* and a bottom portion 30*b*. A clamping mechanism is connects the top portion 30*a* to the bottom portion 30*b*.

FIG. 8A illustrates prior art reducers 31 and FIG. 8B shows the offset reducers 30 of the present invention. The height of both reducers 30 and 31 is the same as indicated by "h". L1 corresponds to the top distance between each pair of reducers 30 or 31, and L2 corresponds to the bottom distance between each pair of reducers 30 or 31. For example, h may be equal to five inches, L1 equal to four and a half inches, and L2 equal to three and a half inches. The reducers 30 reduce the diameter of the flow of product from a first diameter as the product emerges from tile fill pump, for example three inches, to a second diameter, for example two inches. The prior art did not allow for adjustment fill system without removal of components from the frame. Also, on a dual line system, one line could not be adjusted individually.

The reducers 30 of the present invention allow for simple adjustment by turning one or more components 30*a* and 30*b* of the pair of reducers 30. For instance, cartons are delivered on a pair of chains with each pair forming individual pockets for cartons. When a carton is indexed to the fill station, the fill pipes must be positioned appropriately to prevent misfilling. Normal usage will result in the loosing of the chain and thus the repositioning of the pocket. When this occurs, the fill pipes need to be repositioned in order for proper filling. The reducers 30 of the present invention allow for that repositioning to occur without major removal of parts from the fill system. Also, the reducers 30 are able to withstand the steam sterilization process without damage. The repositioning of the reducers in terms of distance is best illustrated in FIG. 9.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A fill system for a form, fill and seal packaging machine, the fill system comprising:

a product tank having a top and a bottom, the product tank in flow communication with a product and a cleaning solution;

at least one fill pipe in flow communication with the product tank;

a cleaning box disposed about the fill pipe;

at least one air filter in flow communication with an air supply at an inlet end and in flow communication with the product tank at an outlet end, the air filter sterilizing air from the air supply to provide sterile air for the product tank and in flow communication with the cleaning box to provide excess air to the cleaning box; and a source of steam, the steam source in flow communication with the air filter and the product tank.

2. The fill system according to claim 1 further comprising an additional fill pipe connected to the product tank, and a pair of offset eccentric reducers interposed between the pair of fill pipes and the product tank, the offset eccentric reducers positioning the pair of fill pipes next to each other.

3. The fill system according to claim 2 further comprising means for measuring the level of the cleaning solution in the product tank to maintain a predetermined level.

4. The fill system according to claim 1 further comprising a tank atmospheric valve for maintaining the pressure in the product tank greater than the pressure at the fill pipe, the pressure maintained by introducing sterile air from the air supply into the product tank.

5. A fill system for a form, fill and seal packaging machine, the fill system comprising:

a product tank in flow communication with a product supply and a cleaning supply;

a source of sterile air in flow communication with the product tank;

a measurement device disposed within the product tank, the measurement device measuring the level of the cleaning supply in the product tank during a cleaning cycle;

a pair of fill pipes connected to the product tank; and a pair of offset eccentric reducers interposed between the pair of fill pipes and the product tank, the offset eccentric reducers positioning the pair of fill pipes next to each other;

whereby the sterile air flowing into the product tank is adjusted according to measurements from the measurement device to maintain a predetermined level of cleaning supply in the product tank during a cleaning cycle.

6. The fill system according to claim 1 further comprising a tank atmospheric valve for maintaining the pressure in the product tank greater than the pressure at the fill pipe, the pressure maintained by introducing sterile air from the source of sterile air into the product tank.

7. A method of cleaning a fill system on a fill, form and seal packaging machine, the fill system having a product tank in flow communication with a fill pipe, a cleaning box and a source of cleaning supply in flow communication with the product tank and the cleaning box, the method comprising:

providing a source of steam and a source of sterile air in flow communication with the product tank and the cleaning box;

introducing the cleaning supply to the fill system, and maintaining a predetermined level of cleaning supply in the product tank;

draining the cleaning supply from the fill system;

flowing steam through the fill system from the source of steam; and flowing sterile air through the system subsequent to flowing steam through the system to cool the fill system.

8. The method according to claim 7 further comprising flowing sterile air into the product tank to maintain the predetermined level of the cleaning supply in the product tank.

9. The method according to claim 7 further comprising means for measuring the level of the cleaning solution in the product tank to maintain a predetermined level.

10. The method according to claim 7 further comprising providing air from an air supply and filtering the air thereby sterilizing the air.

11. The method according to claim 7 wherein the fill system comprises a pair of fill pipes connected to the product tank, and a pair of offset eccentric reducers interposed between the pair of fill pipes and the product tank, the offset eccentric reducers positioning the pair of fill pipes next to each other.

12. A method of hygienically filling a series of cartons being processed along a form, fill and seal packaging machine, the method comprising:

providing a product to be filled in each of the cartons, the product residing in a product tank in flow communication with a pair of fill pipes having a pair of offset reducers disposed between the pair of fill pipes and the product tank;

providing a source of sterile air in flow communication with the product tank and the pair of fill pipes; and filling a pair of cartons with product from the product tank through the pair of fill pipes while simultaneously flowing sterile air in and around the fill pipes.

* * * * *